United States Patent [19]

Suzuki et al.

[11] 4,410,837

[45] Oct. 18, 1983

[54] DISCHARGE LAMP LIGHTING DEVICE

[75] Inventors: Shunichi Suzuki, Himeji; Masaharu Kotaka, Takasago, both of Japan

[73] Assignee: Ushio Denki Kabushiki Kaisha, Japan

[21] Appl. No.: 287,575

[22] Filed: Jul. 28, 1981

[30] Foreign Application Priority Data

Aug. 20, 1980 [JP] Japan ..... 55-113371

[51] Int. Cl.[3] ..... H05B 37/00

[52] U.S. Cl. ..... 315/289; 315/170; 315/176; 315/241 R; 315/DIG. 7

[58] Field of Search ..... 315/DIG. 2, 289, 290, 315/170, 176, DIG. 7

[56] References Cited

U.S. PATENT DOCUMENTS

| | | | |
|---|---|---|---|
| 2,737,612 | 3/1956 | Sims | 315/289 |
| 3,259,796 | 7/1966 | Hallay | 315/176 |
| 3,622,838 | 11/1971 | Michalski | 315/289 |
| 3,732,460 | 5/1973 | Wattenbach | 315/289 |
| 4,210,850 | 7/1980 | Britton | 315/DIG. 2 |

*Primary Examiner*—Harold A. Dixon

*Attorney, Agent, or Firm*—Ziems & Walter

[57] ABSTRACT

A device for lighting a discharge lamp such as a xenon short-arc lamp is provided. The device includes a starter comprising a starter energizing capacitor connected to the boost voltage charging capacitor, a thyristor, a high voltage pulse transformer, a discharge gap, a starting capacitor, a diode and a Tesla coil. The starter is actuated with the energy charged in the boost voltage charging capacitor without any special power source therefor. The ignition voltage of the thyristor is higher than the output voltage of the power circuit of the ballast.

1 Claim, 13 Drawing Figures

VOLTAGE
VA
VC
TIME

VOLTAGE
TIME

VOLTAGE
TIME
t1
t2

VOLTAGE
VA
VC
TIME

VOLTAGE
VA
VF
TIME

VOLTAGE
TIME
t3
t4

DISCHARGE LAMP LIGHTING DEVICE

BACKGROUND OF THE INVENTION

1. Field of the Invention

The present invention relates to a discharge lamp lighting device.

2. Description of the Prior Art

Heretofore, there have been proposed many different discharge lamp lighting devices; generally, they comprise, in order to effectively light the discharge lamp, a power circuit which supplies a constant current or power corresponding to the rating of an object discharge lamp, a starter which applies a high voltage pulse to cause a dielectric break-down in the discharge lamp in order to start lighting the lamp, and a boost voltage supplying circuit to provide a boost voltage which facilitates the discharge lamp to transfer to a stable discharge state at earlier stage of lighting.

Said starter is automatically actuated when the power circuit and the boost voltage supplying circuit have completed the preparatory operation, and also automatically stopped when the discharge lamp is lighted; the starter should preferably be controlled in this way.

FIG. 1 shows an explanatory circuit diagram of a conventional discharge lamp lighting device with such functions. In this example, between the output terminals of the power circuit 2 connected to an A.C. power source 1 connected is a boost voltage charging capacitor C1 across which is connected to a boost voltage generator circuit 3. The above components form together a ballast 4. The power circuit 2 comprises a transformer, rectifier, and filter circuit. If a filter capacitor for the filter circuit also serves as the boost voltage charging capacitor, the boost voltage generator circuit may be connected across the filter capacitor. The discharge lamp L is connected by means of a starter 5 to the output terminal of the ballast 4, more particularly across the capacitor C1. The starter 5 is formed by connecting the primary coil of a commercial high voltage transformer T1 to a commercial power source 6 through a normally open relay contact ry of a relay RY inserted in parallel with said capacitor C1, and connecting the primary coil of a Telsa coil TC to the secondary coil of said transformer T1 by means of a starting capacitor C2 and discharge gap G, and interposing the secondary coil of the Tesla coil TC between said capacitor C1 and discharge lamp L.

The discharge lamp lighting device of such construction functions as follows: When the ballast 4 is actuated, the capacitor C1 is charged with boost voltage from the boost voltage generator circuit 3, and the voltage $V_C$ across the capacitor increases to reach a boost voltage $V_A$ of a required amplitude, as shown in FIG. 2(A). Then, at the time $T_1$, the relay RY is energized with said boost voltage $V_A$ so that the normally open relay contact ry is closed. An A.C. voltage from the commercial A.C. power source 6 is applied to the commercial high voltage transformer T1, as shown in FIG. 2(B). The high voltage current induced in the secondary coil of the transformer T1 flows to the primary coil of the Tesla coil TC so that high voltage pulses are induced in the secondary coil of the Tesla coil TC, as shown in FIG. 2(C). The high voltage pulses are applied to the discharge lamp L where dielectric break-down occurs to start discharging. When the lamp L is lighted, the voltage $V_C$ across the capacitor C1 drops to the rated voltage so that the relay RY is deenergized. Then, the normally open contact ry thereof is opened with the result that the generation of high voltage pulses from the Tesla coil TC is suspended. More particularly, when the ballast 4 is ready for lighting the discharge lamp L, the starter 5 is actuated, and when the discharge lamp L is lighted, it is stopped. This operation is automatically done by setting the relay actuating voltage to the boost voltage $V_A$.

However, in such conventional discharge lamp lighting device, since the commercial power source 6 is used as power source to energize the starter 5 in addition to the power source 1 for the power circuit 2, the entire device has a complicated construction; further, because of the commercial high voltage transformer T1 being used to apply the high voltage at the secondary coil thereof to the Tesla coil TC at the primary coil thereof, said starter 5 consumes much power. In case this starter 5 is adopted in the lighting device for a discharge lamp L such as xenon shortarc lamp of 350 W in rating, for instance, electric energy as large as 100 VA is consumed to light the lamp L.

SUMMARY OF THE INVENTION

Accordingly, the present invention has the object to overcome the above-mentioned drawbacks of the conventional discharge lamp lighting devices, by providing a discharge lamp lighting device which consumes only a little power, requires no special power source for the starter and is positively and automatically driven with the power supplied from a ballast, thus the entire device being considerably simplified.

DETAILED DESCRIPTION OF THE PREFERRED EMBODIMENTS

The present invention will be better understood from the ensuing description made by way of example of one preferred embodiment, non-limitative but only for illustration, with reference to the accompanying drawings.

Figure 1:
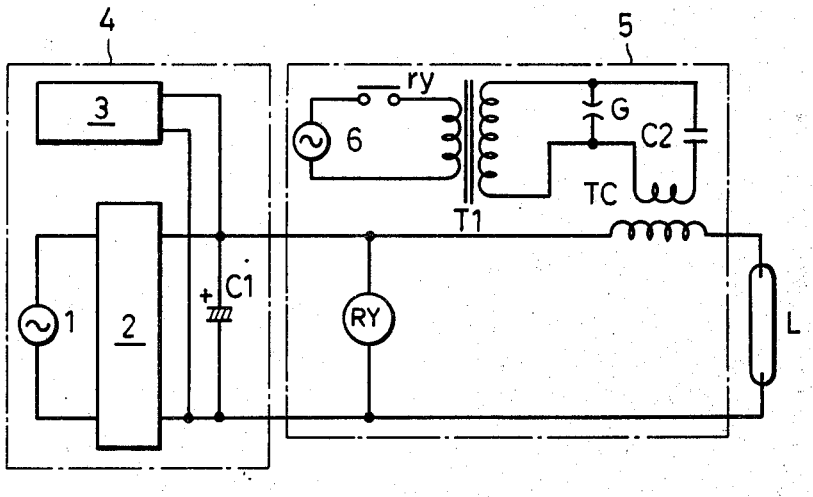
FIG. 1 is an explanatory circuit diagram of a conventional discharge lamp lighting device.
Figure 3:
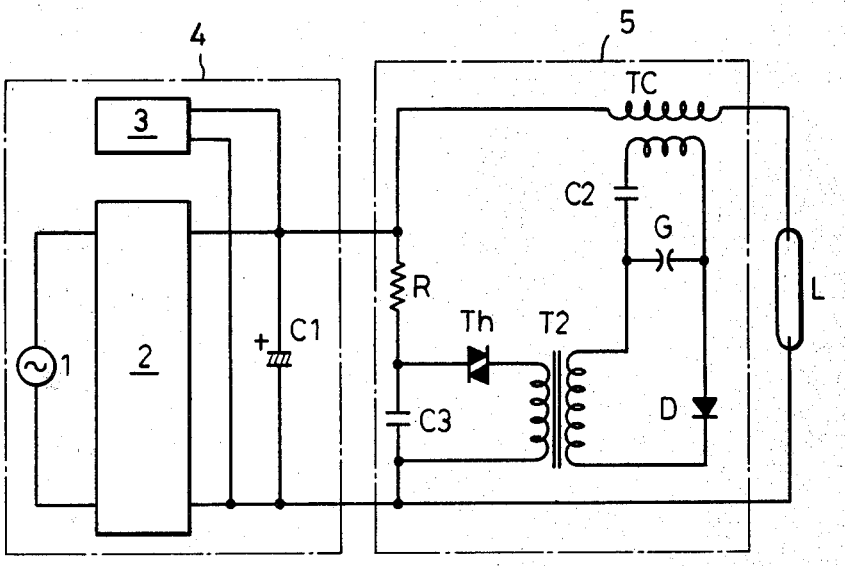
FIG. 3 is an explanatory circuit diagram of the discharge lamp lighting device according to the present invention.

Referring now to FIG. 3, in the device according to the present invention, between the positive and negative output terminals of the ballast 4, namely, across the boost voltage charging capacitor C1 connected in parallel is a series circuit of a resistor R and a starter energizing capacitor C3. Across this capacitor C3 connected through a thyristor Th is the primary coil of a high voltage pulse transformer T2, these elements forming together a closed circuit. The primary coil of the Telsa coil TC is connected via a starting capacitor C2 and a diode D to said high voltage pulse transformer T2, while a discharge gap G is connected in parallel to the capacitor C2 and the primary coil of the Telsa coil TC, these three elements thus forming together a closed circuit. The secondary coil of the Telsa coil TC is connected at the one end thereof to the positive output terminal on the ballast 4, while the other end is connected to the anode of the discharge lamp L. The ignition voltage of said thyristor Th is set to a required superposed voltage.

Figure 4:
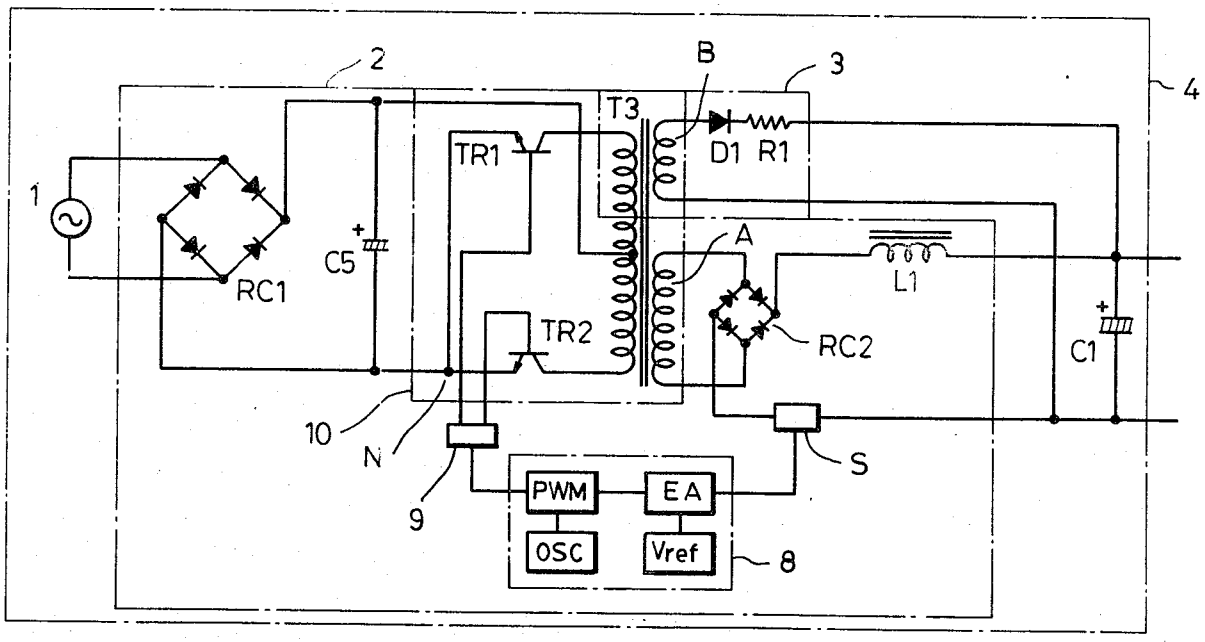
FIG. 4 is a circuit diagram showing an example D.C. power source and the high voltage generator circuit in the ballast.

FIG. 4 shows an example power circuit 2 and the boost voltage generator circuit 3 in the ballast 4; in this example, the power circuit adopts a semiconductor-controlled switching system. To the A.C. power source 1 connected by means of a D.C. power circuit formed by a rectifier RC1 and capacitor C5 is an inverter 10 composed of semiconductor switching elements or transistors TR1 and TR2 and a transformer T3 which has two secondary outputs A and B, one (A) of which is connected to a rectifier RC2. Through a current senser element S connected to the negative side of the rectifier RC2, a filter circuit consisting of a high frequency choke coil L1 connected to the positive side of the rectifier RC2 and the boost voltage charging capacitor C1. Since a high frequency alternating current is delivered from the inverter 10, the high frequency choke coil L1 suitable for high frequency is used as a smoothing coil in the filter circuit.

The discharge lamp L is energized by the main circuit composed of said inverter 10, rectifier RC2 and said filter circuit after the state of the lamp lighted is stabilized. For a lowest possible running cost of this main circuit, the output voltage of the main circuit for maintaining the steady or stable state of the lamp lighted is designed to be equal or a little higher the rated voltage of the discharge lamp L. With this design alone, however, the transition from glow to arc discharge, which is encountered at the initial stage after starting of the discharge lamp, that is to say, lighting thereof at time of starting will not occur easily. In order to solve this problem, a boost voltage supplying circuit is connected across said capacitor C1. This boost voltage supplying circuit is commonly comprised by a transformer, rectifier, resistor and (boost voltage) charging capacitor; in the example illustrated in FIG. 4, however, the transformer T3 is provided with a second output B, one of the ends of which is connected through a series circuit formed by a rectifying diode D1 and resistor R1 to the positive side of the capacitor C1 forming part of said filter circuit, the other end being connected to the negative side of said capacitor C1. As apparent from the above, in this example, the transformer T3 is commonly used by both the main circuit and the boost voltage generator circuits, while the capacitor C1 is also commonly used for filter capacitor and boost voltage charging capacitor.

On the other hand, the signal from said current senser element S is applied as feedback signal to a pulse width control circuit 8 composed of an error amplifier EA connected to a reference voltage source $V_{ref}$ and a pulse width modulator PWM connected to an oscillator OSC to adjust, namely, increase or decrease the switching pulse width of said semiconductor switching elements TR1 and TR2 through a drive circuit 9, thus controlling the current supplied to the discharge lamp 6 so as to be constant.

Figure 5:
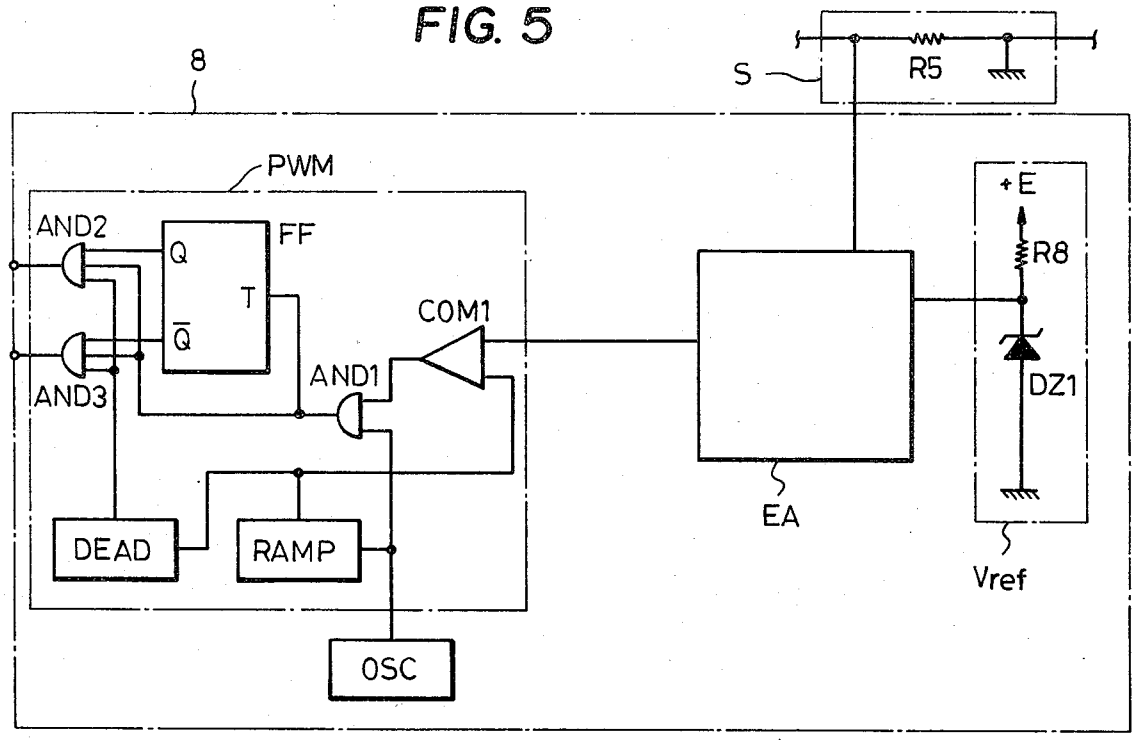
FIG. 5 is a circuit diagram showing an example current senser element and pulse width control circuit.

In the example current sensor element S and pulse width control circuit 8 shown in FIG. 5, the current senser element S comprises a current sensing resistor R5. The reference voltage source $V_{ref}$ is formed by a series circuit of a grounded Zener diode DZ1 and a resistor R8 connected to an auxiliary power source 20 (+E) which will be described later; the output from the common point of connection or junction between the above-mentioned Zener diode DZ1 and resistor R8 is applied, along with the output from said current senser element S, to the 2 input terminals, respectively, of the error amplifier EA.

Figure 6:
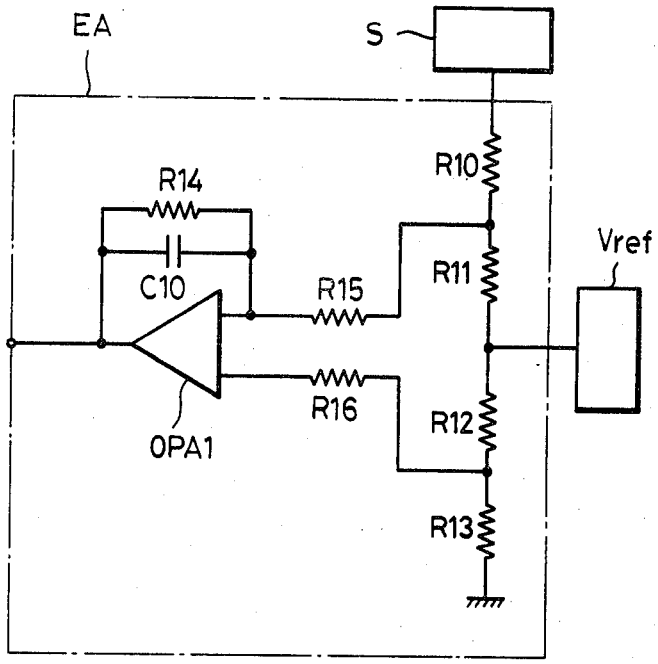
FIG. 6 is a circuit diagram showing an example error amplifier.

An example error amplifier EA is illustrated in FIG. 6. As seen from this Figure, the error amplifier EA has an operational amplifier OPA1, together with voltage dividing resistors R10 and R11 which produce an inversion input signal to the operational amplifier OPA1 from the outputs from said current detector S and reference voltage source $V_{ref}$, and voltage dividing resistors R12 and R13 which produce a non-inversion input signal to OPA1 from the above outputs. R14, R15, and R16 are resistors, and C10 is a phase compensating capacitor. The output signal from the operational amplifier OPA1 increases or decreases in level with reference to the rated current of the discharge lamp L, i.e. it increases in level with the increase of the actually flowing current as the inversion input signal decreases, while the output signal will decrease with the decrease of the lamp current.

Figure 7:
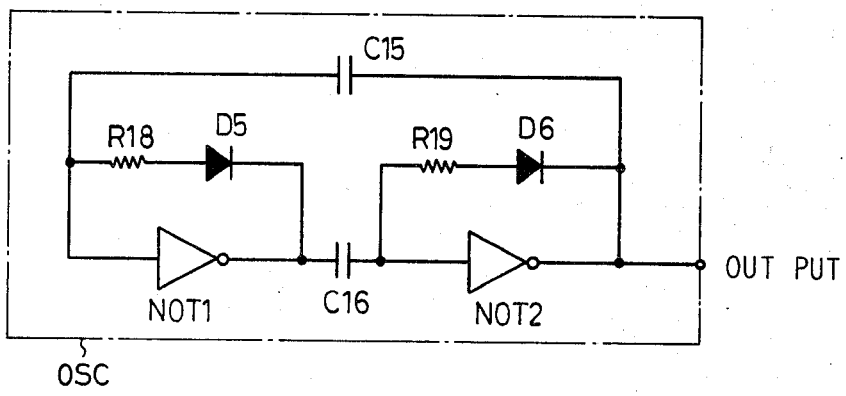
FIG. 7 is a circuit diagram illustrating an example oscillator.

FIG. 7 illustrates an example oscillator circuit OSC; in this circuit, NOT1 and NOT2 are NOT circuits or inverters, D5 and D6 are diodes, R18 and R19 are resistors, and C15 and C16 are capacitors, respectively. This oscillator OSC generates a square-wave output signal $V_{OSC}$ as shown in FIG. 8(A).

The pulse width modulator PWM shown in FIG. 5 comprises a saw-tooth wave signal generator circuit RAMP which, receiving the signal from the oscillator OSC, produces a saw-tooth wave signal. This example saw-tooth wave signal generator circuit RAMP comprises, as shown in FIG. 9, a NOT circuit or inverter NOT5 to which the signal from the oscillator OSC is applied, a transistor TR5 connected at the base thereof through a resistor 20 to said NOT circuit or inverter NOT5, and an operational amplifier OPA5 connected by means of a resistor R21 to the transistor TR5 at the collector thereof. R22 and R23 are resistors, and C20 is a capacitor. The saw-tooth wave signal generator circuit RAMP produces a saw-tooth wave signal $V_{RAMP}$ of a same frequency as the oscillating frequency of the oscillator OSC as shown in FIG. 8(B).

Figure 8:
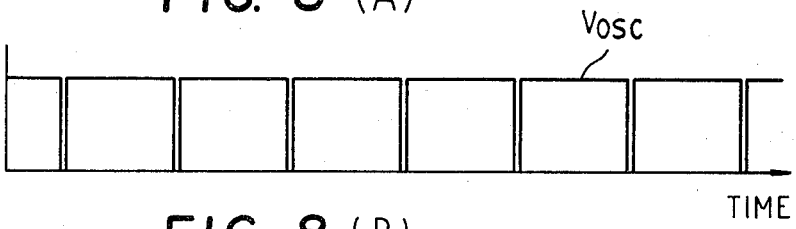
FIGS. 8(A) through 8(C) show the output waveforms of the oscillator, saw-tooth wave generator circuit and dead time adjustment circuit, respectively.
Figure 8:
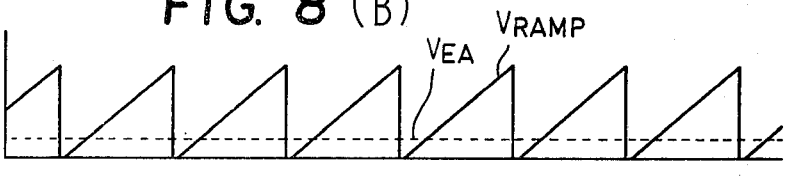
Figure 8:
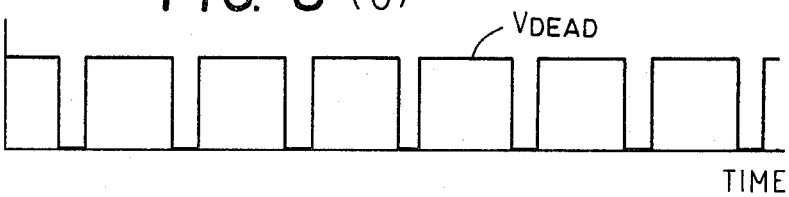
Figure 9:
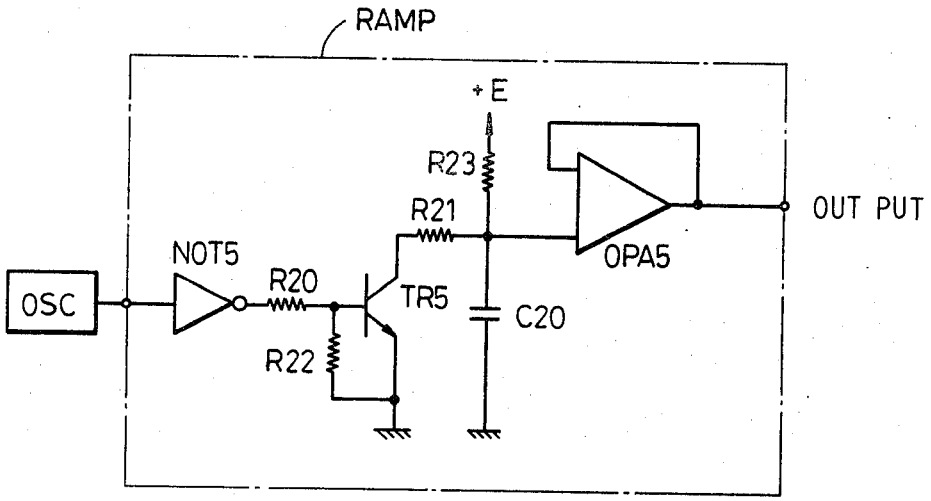
FIG. 9 is a circuit diagram showing an example saw-tooth wave generator circuit.

A comparator COM1 of the pulse width modulator PWM compares the output signal from said error amplifier EA (shown with broken line in FIG. 8(B), for example) with the output signal from the saw-tooth wave signal generator circuit RAMP to produce a "low-level" output signal when the output voltage $V_{EA}$ from the error amplifier EA is higher than the voltage of saw-tooth wave signal, and a "high-level" output signal when the output voltage $V_{EA}$ is lower.

The output from an AND gate AND1 is a logical product of the output from said comparator COM1 by the output signal $V_{OSC}$ from the oscillator OSC, accordingly, the output is a modulated signal in pulse width of the output $V_{OSC}$ from the oscillator OSC.

The output from the AND gate AND1 is applied to the input terminal T of a flip-flop circuit FF, and the outputs from the AND gates AND2 and AND3 connected to the output terminals Q and $\overline{Q}$ of said flip-flop circuit FF are the logicl product of the outputs from the flip-flop circuit FF, AND gate AND1 and a dead time adjustment circuit DEAD.

Figure 10:
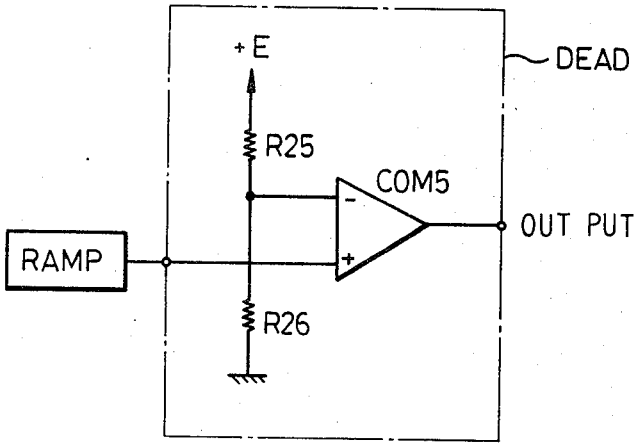
FIG. 10 is also a circuit diagram illustrating an example dead time adjustment circuit.

The dead time adjustment circuit DEAD is to prevent the semiconductor switching elements TR1 and TR2 from crosscurrent conduction which causes to make both switching elements conductive at a same time due to the lengthened time of conduction (storage time) due to the charge stored in the base of the elements TR1 and TR2; as shown in FIG. 10, for example, this circuit is formed by a comparator COM5 to which applied are the output signal from the saw-tooth wave signal generator RAMP and the voltage +E from the auxiliary power source 20 shunted by voltage dividing resistors R25 and R26. The output waveform $V_{DEAD}$ of this dead time adjustment circuit DEAD is as shown in FIG. 8(C), for example, and only while this signal is at high level, the AND gates AND2 and AND3 are opened.

Figure 11:
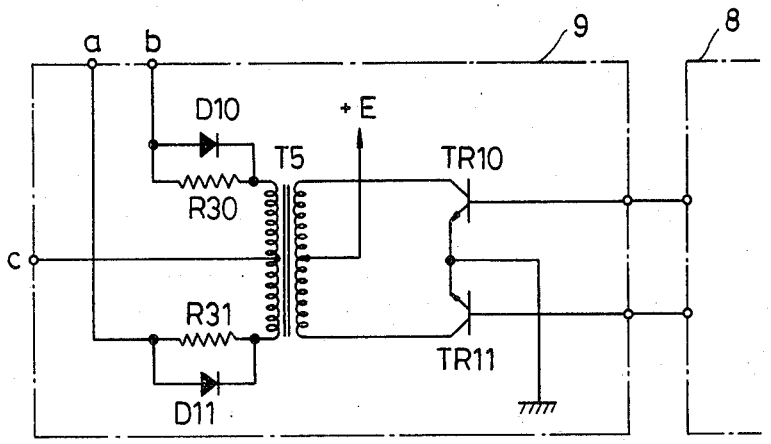
FIG. 11 is a circuit diagram showing an example drive circuit.

FIG. 11 illustrates an example drive circuit 9. In this example, the drive circuit 9 comprises two transistors TR10 and TR11 connected at the emitters thereof to each other and applied with the output from the above-mentioned pulse width control circuit 8, and a transformer T5. R30 and R31 are resistors, and D10 and D11 are diodes. The output terminals a and b are connected to the semiconductor switching elements TR1 and TR2 at the bases thereof, respectively, and the terminal c from the intermediate point of the primary coil of the transformer T5 is connected to the junction N indicated in FIG. 4 of the interconnected emitters of the switching elements TR1 and TR2. The intermediate point of the secondary coil of the transformer T5 is connected to the auxiliary power source 20.

Figure 12:
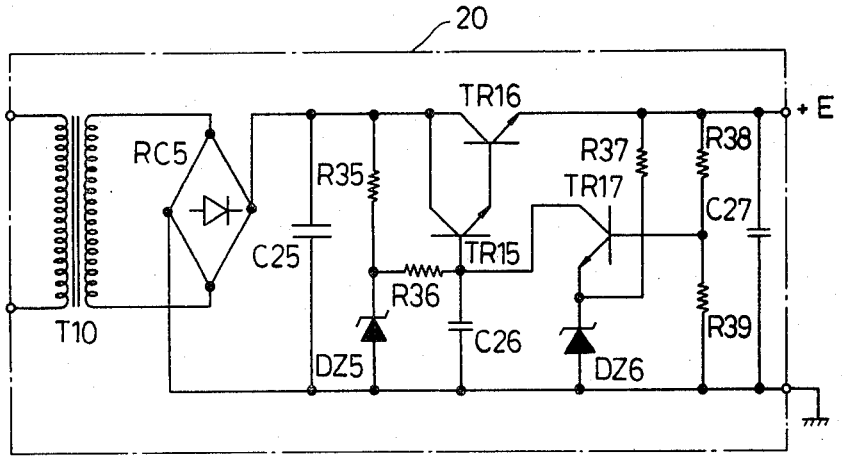
FIG. 12 is a circuit diagram showing an example auxiliary power source.

FIG. 12 shows an example auxiliary power source 20 which applies a required voltage to the above-mentioned error amplifier EA, pulse width modulator PWM, reference voltage source $V_{ref}$ and the drive circuit 9. This example auxiliary power source 20 comprises a transformer T10 of which the primary coil is connected to the commercial A.C. power source, and a rectifier RC5 connected to the secondary coil of the transformer T10, to provide a constant D.C. voltage +E stabilized through Zener diodes DZ5 and DZ6; transistors TR15, TR16 and TR17, capacitors C25, C26, and C27, and resistors R35, R36, R37, R38 and R39.

Figures 2A, 2B, 2C, 13A, 13B, 13C:
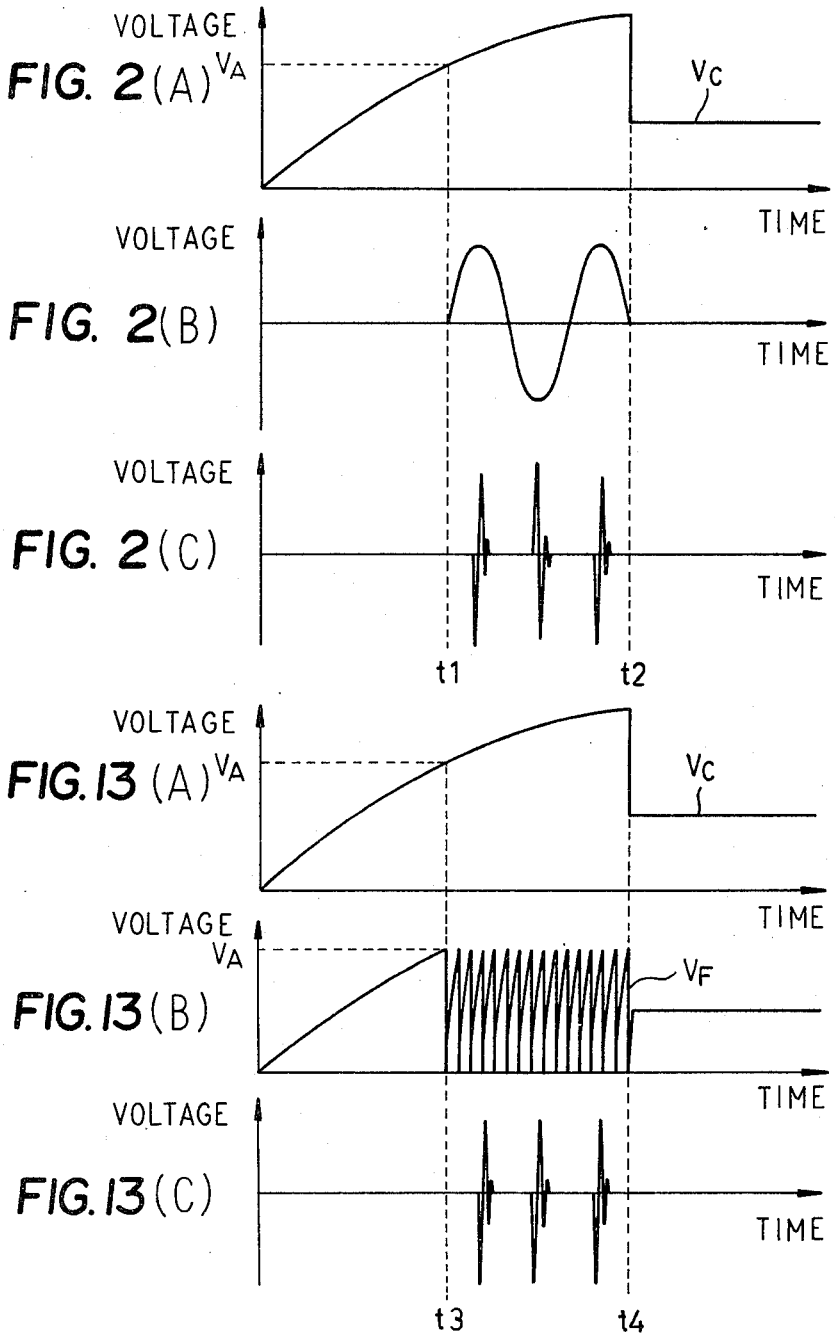
FIGS. 2(A) through 2(C) show waveforms of the voltage across the boost voltage charging capacitor C1, commercial A.C. power voltage fed to the high voltage transformer and a high voltage pulses from the Tesla coil, respectively.
FIGS. 13(A) through 13(C) show the waveforms of a voltage across the boost voltage charging capacitor C1, voltage across the starter energizing capacitor C3 and of high voltage pulses from the Telsa coil, respectively.

The construction of the inventive discharge lamp lighting device has been described in the foregoing, and this device functions as follows: When the output voltage $V_C$ across the boost voltage charging capacitor C1, namely, the output voltage from the ballast 4, increases to reach a required level of boost voltage $V_A$, also the voltage $V_F$ across the starter energizing capacitor C3 of the starter 5 reaches the boost voltage $V_A$ as shown in FIGS. 13(A) and 13(B). Accordingly, at this time $t_3$, the thyristor Th is ignited so that the charged energy in the capacitor C3 is discharged and applied to the primary coil of the high voltage pulse transformer T2. After that, the capacitor C3 is charged via resistor R up to the boost voltage $V_A$ again. The thyristor Th is ignited again, so the discharge current from the capacitor C3 is supplied to the primary coil of the high voltage pulse transformer T2. This operation is repeated and a voltage of a frequency as high as hundreds Hz to 1 kHz is applied to the primary coil of the high voltage pulse transformer T2, as shown in FIG. 13(B). With this high frequency voltage, there induces in the secondary coil of the high voltage pulse transformer T2 a high voltage corresponding to said high frequency voltage; this high voltage is rectified by the diode D, then charged in the starting capacitor C2. When the charge voltage in this capacitor C2 reaches the discharge starting voltage for the discharge gap G, the capacitor C2 discharges through the discharge gap G so that the energy charged in the capacitor C2 is supplied to the primary coil of the Telsa coil TC. As the result, there induces a high voltage pulses in the secondary coil of the Telsa coil TC, as shown in FIG. 13(C), which high voltage pulses are applied to the discharge lamp L where dielectric breakdown occurs and which will thus be lighted.

When the discharge lamp L is thus lighted, the voltage $V_C$ across the boost voltage charging capacitor C1 is reduced to the rated voltage, and also the voltage $V_F$ across the starter energizing capacitor C3 is decreased to a value much lower than the boost voltage $V_A$. Thus, the starter is stopped operating.

As having been described in the foregoing, the inventive discharge lamp lighting device employs as the circuit elements comprising the starter 5, a starter energizing capacitor C3, thyristor Th, high voltage pulse transformer T2 for high frequency which may be a small one and a diode D in lieu of the commercial high voltage transformer T1. Thus, the starter 5 consumes only a very little power; it can be connected directly across the boost voltage charging capacitor C1 and driven by the ballast 4. More particularly, a starter for a discharge lamp L such as a xenon short arc lamp of 350 W in rating, for instance, can be designed so as to consume only about 2.5 VA. Namely, the energy charged in the boost voltage charging capacitor C1 is enough for actuating the starter. Thus no special power source for energizing the starter 5 is necessary, thereby permitting the entire discharge lamp lighting device to be considerably simplified.

As seen from the description having made in the foregoing, the present invention can minimize the power consumption of the starter so that the starter can be driven by a ballast without using any special commercial A.C. power source thereof, thus providing a discharge lamp lighting device simplified as a whole.

What is claimed is:

1. A discharge lamp lighting device, comprising:

a ballast circuit (4) for supplying electrical energy to a discharge lamp (L), said ballast circuit including a first power supply circuit (2), a second power supply circuit (3) connected in parallel with said first power supply circuit, said second power supply circuit providing a voltage output higher than said first power supply circuit output voltage, and a storage capacitor (C1) connected across said parallel connected first and second power supply circuits; and a discharge lamp circuit connected to said ballast circuit (4) and including a series-connected discharge lamp (L) and secondary of a Tesla Coil (TC) connected across said storage capacitor (C1), and a starter circuit for starting said discharge lamp, said starter circuit including a high voltage pulse transformer (T2) having a primary and secondary, said primary of said pulse transformer connected through a thyristor (Th) across a starter energizing capacitor (C3), said starter energizing capacitor connected in parallel circuit with said storage capacitor (C1), said secondary of said high voltage pulse transformer and a series-connected diode (D) connected first in shunt acrosss a discharge gap (G) and secondly in shunt across a series-connected starter capacitor (C2) and a primary of said Tesla Coil, the ignition voltage of said thyristor being higher than the output voltage of said main power supply circuit.

* * * * *

UNITED STATES PATENT AND TRADEMARK OFFICE

CERTIFICATE OF CORRECTION

PATENT NO. : 4,410,837

DATED : October 18, 1983

INVENTOR(S) : SHUNISHI SUZUKI and MASAHARU KOTAKA

It is certified that error appears in the above—identified patent and that said Letters Patent is hereby corrected as shown below:

Col. 2, line 19, "shortarc" should be --short-arc--.

Col. 5, line 17, "logicl" should be --logical--.

Col. 5, line 22, "crosscurrent" should be --cross-current--.

Col. 6, line 57, "thereof," should be --therefor,--.

Claim 1, col. 8, line 5, "acrosss" should be --across--.

Signed and Sealed this

*Twenty-seventh* Day of *December 1983*

[SEAL]

*Attest:*

GERALD J. MOSSINGHOFF

*Attesting Officer*

*Commissioner of Patents and Trademarks*